United States Patent [19]

Wu

[11] Patent Number: 4,651,115

[45] Date of Patent: Mar. 17, 1987

[54] WAVEGUIDE-TO-MICROSTRIP TRANSITION

[75] Inventor: You-Sun Wu, Hamilton, N.J.

[73] Assignee: RCA Corporation, Princeton, N.J.

[21] Appl. No.: 696,735

[22] Filed: Jan. 31, 1985

[51] Int. Cl.[4] ..... H01P 5/107

[52] U.S. Cl. ..... 333/26; 333/34

[58] Field of Search ..... 333/21 R, 26, 34, 248

[56] References Cited

U.S. PATENT DOCUMENTS

| | | | |
|---|---|---|---|
| 2,721,939 | 10/1955 | Hershfield et al. | 333/26 X |
| 3,105,946 | 10/1963 | Beljers et al. . | |
| 3,265,995 | 8/1966 | Hamasaki | 333/26 X |
| 3,478,282 | 11/1969 | Smith . | |
| 3,737,812 | 6/1973 | Gaudio et al. . | |
| 3,758,886 | 9/1973 | Landry et al. | 333/26 |
| 4,346,355 | 8/1982 | Tsukii | 333/34 X |
| 4,349,790 | 9/1982 | Landry . | |

FOREIGN PATENT DOCUMENTS

| | | | |
|---|---|---|---|
| 1133631 | 1/1985 | U.S.S.R. | 333/26 |

OTHER PUBLICATIONS

Title: "Waveguide-to-Microscript Transition Uses Evanescent Mode" Published in: Microwaves and RF Magazine, Author: Bharj et al–Date: Jan. 1984, pp. 99, 100 & 134.

Title: "Ridge Waveguide Used in Microscrip Transition" Published in: Microwaves and RF Magazine, Author: Moochalla et al, Published: Mar. 1984, pp. 149–152.

*Primary Examiner*—Paul Gensler

*Attorney, Agent, or Firm*—Joseph S. Tripoli; Robert L. Troike; William H. Meise

[57] ABSTRACT

A waveguide-to-coax-to-microstrip transition includes a rectangular waveguide portion having a ridged impedance transformer attached to the lower wide wall. The waveguide portion is closed off by a conductive wall through an aperture in which the center conductor of a coaxial transmission-line passes. A ridge extension isolated from all four walls of the rectangular waveguide couples the ridge to the center-conductor of the coax. For broadbanding, a glass plate is located between the ridge extension and the upper wide wall. The strip conductor of a microstrip transmission-line is connected to the center conductor of the coaxial transmission-line. The plane of the dielectric plate of the microstrip may be oriented parallel to the narrow wall of the rectangular waveguide to achieve high packing density.

17 Claims, 8 Drawing Figures

WAVEGUIDE-TO-MICROSTRIP TRANSITION

BACKGROUND OF THE INVENTION

This invention relates to a waveguide-to-microstrip transition which provides broad bandwidth and which allows any desired orientation of the plane of the microstrip to the walls of the waveguide.

A transmission-line is a conductor arrangement for guiding electromagnetic waves from one location to another. One of the the simplest types of transmission-line is a two-wire or parallel-wire transmission-line, which consists of a pair of parallel wires which guide an electromagnetic wave propagating in the region around and between the wires. Such two-wire transmission-lines are inexpensive, effective and in very common use, but have certain disadvantages for use at microwave frequencies, which disadvantages include a relatively high degree of coupling between the transmission line and its environment, which allows undesired external noise signals to be added to the signal being propagated on the transmission-line, and the concomitant problem of leakage away from the transmission-line of the wave being guided which results in a propagation or transmission loss in excess of that due to resistive losses in the transmission line. Because of these problems, other types of transmission-line are more commonly used at microwave frequencies.

A coaxial transmission line (coax) is a tubular or pipe-like outer conductor which is coaxial with a central conductor or center-conductor. Coaxial transmission-lines confine the electromagnetic field in the region between the center conductor and the outer conductor. The outer conductor isolates the signal from the environment. Consequently, the signal being propagated thereon is relatively unaffected by the environment. Coaxial transmission lines are very popular, but have relatively high loss at the higher microwave frequencies.

Another type of transmission-line is the waveguide, which is a hollow conductive tube in which the electromagnetic energy is propagated without the benefit of a center-conductor. Waveguides have relatively narrow bandwidth, but within that bandwidth may have lower loss than coax.

Another type of transmission line is the so-called microstrip transmission line, which has a similarity to both two-wire transmission lines and to coax. A microstrip transmission-line consists of a relatively large ground plane from which a relatively narrow strip conductor is separated by a thin layer of dielectric material. Strip conductors are often manufactured by printing of the conductors onto plates of dielectric material. They are widely used for the interconnections in microwave active circuits such as amplifiers, circulators and the like.

It often happens that the need arises for coupling signals from waveguide to a TEM (transverse-electromagnetic) transmission-line such as coax or microstrip. This is normally accomplished by a transition. Several problems arise in design and manufacture of such transitions. One problem arises from the need to couple energy from one type of transmission line to the other without reflections caused by impedance mismatches. Such reflected energy results in less energy being propagated through the transition, and is therefore undesirable. It is generally possible by tuning to provide essentially zero loss at a single frequency. The difficulty arises when it is desired to couple energy with low loss over a broad range of frequencies (over a broad bandwidth). Another problem which arises lies in the orientation of the output transmission line relative to the input transmission-line. U.S. Pat. No. 3,478,282 issued Nov. 11, 1969 to Smith describes a waveguide-to-coax transition in which a stepped ridge provides broadband coupling between a waveguide and coaxial line. The coaxial line has its axis at right angles to the direction of propagation in the waveguide.

U.S. Pat. No. 3,737,812 issued June 5, 1973 to Gaudio et al describes a waveguide-to-coaxial transition having a stepped ridge for broadband impedance matching to a coax transmission-line, the axis of which lies in the same direction as the direction of propagation in the waveguide.

The article "Waveguide-to-Microstrip Transition Uses Evanescent Mode" by Bharj et al, published by Microwaves & RF Magazine, January 1984 describes a waveguide-to-microstrip transmission using a stepped ridge. This arrangement suffers from the problem of unwanted losses in the transition due to radiation of a significant amount of energy from the open end of the waveguide. This occurs because not all the energy is constrained within the region of ridge and is therefore not coupled to the microstrip. Also, the bandwidth tends to be restricted.

A broadband waveguide-to-coax or waveguide-to-microstrip transition is desired.

SUMMARY OF THE INVENTION

A waveguide-to-coax transition includes first and second mutually parallel conductive wide walls equidistant from a first plane and first and second mutually parallel conductive narrow walls equidistant from a second plane orthogonal to the first plane. The walls are coupled together along the edges to define a rectangular waveguide having an axis coextensive with the juncture of the first and second planes. A conductive end plate defining an aperture is orthogonal to both the first and second planes and is coupled to the four walls of the rectangular waveguide for closing off the rectangular waveguide, except for the circular aperture. The plate is located so that the center of the circular aperture lies in the second plane. A coaxial transmission-line includes an outer conductor which terminates at the circular aperture and a center conductor which passes through the center of the aperture. A stepped ridge is centered on the second plane and coupled to the first wide wall. The stepped ridge includes more than one step, the steps having distances from the second wide wall which decrease within increasing proximity of the steps to the conductive end plate. A ridge extension is cantilivered from the stepped ridge and extends from one of the several steps to the center conductor. The bandwith of the transition is improved by a dielectric plate coupled between the ridge extension and the second wide wall.

DESCRIPTION OF THE INVENTION

Figure 1:
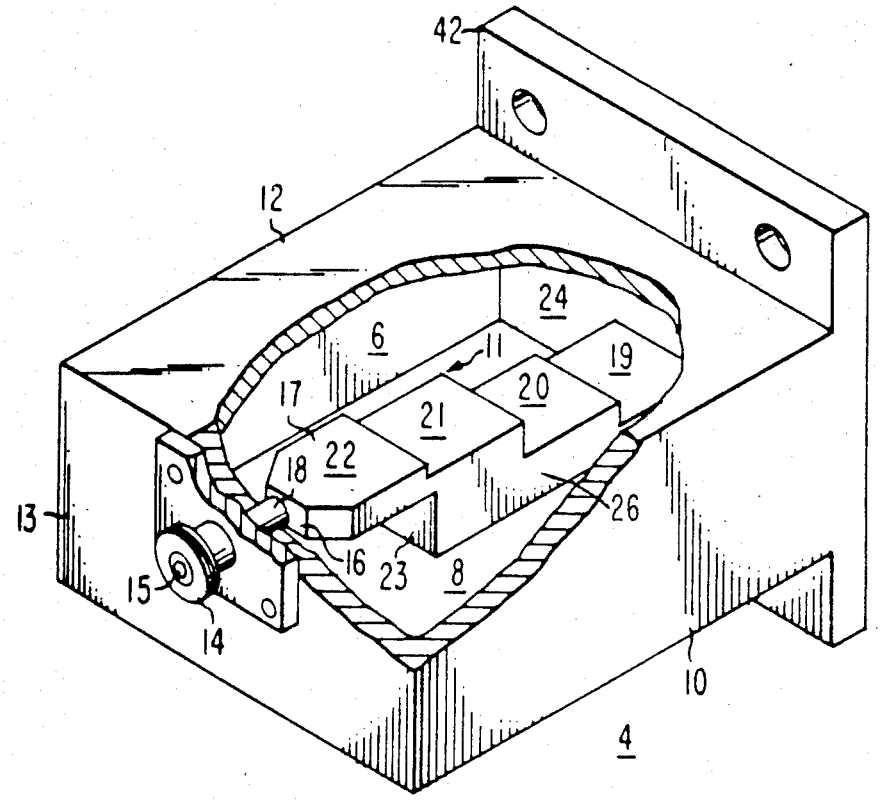
Fig. 1 PRIOR ART
FIG. 1 is a view of a prior-art waveguide-to-coax transition.
Figure 2:
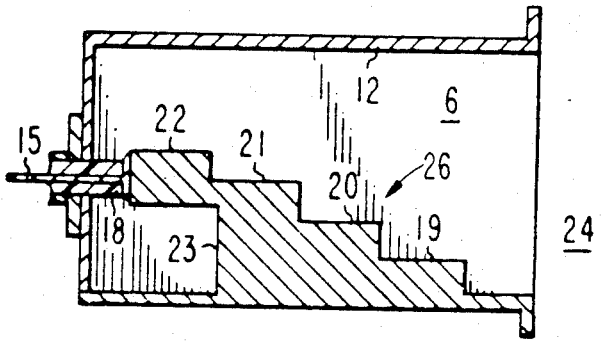
Fig. 2 PRIOR ART
FIG. 2 is a cross-sectional view thereof.

FIG. 1 illustrates a waveguide-to-coaxial transmission line transition 4 as described in the aforementioned Gaudio et al patent. It should be noted that there is no difference between a waveguide-to-coax transition and a coax-to-waveguide transmission, the two being the same. Transition 4 includes a portion of waveguide defined by mutually parallel wide walls 8 and 12 separated by narrow walls 6 and 10, which together define an open rectangular-waveguide port designated generally as 24. At the end of the waveguide section opposite port 24 is a conductive plate 13 upon which is mounted a coaxial connector 14 which includes a coaxial transmission line having a center-conductor pin 15 and an outer conductor formed by the body of connector 14. Center pin 15 passes through an aperture in wall 13 and is isolated therefrom by a dielectric cylinder 18. Pin 15 and dielectric 18 together form a coaxial transmission line passing through the aperture in wall 13. Impedance match or good energy coupling between the coax and the waveguide is provided by a stepped conductive ridge designated generally as 11 which is mechanically fastened to wide wall 8. Ridge portion 26 terminates at a flat wall 23 facing end plate 13, and an extension 17 of the ridge provides coupling to center pin 15. Ridge 11 may be considered to be an arrangement for redistributing the electric field as it arrives from a feed waveguide (not illustrated) at input port 24 in such a manner to concentrate the fields into the region between the ridge and upper wide wall 12. The illustrated four steps 19, 20, 21 and 22 have dimensions selected to provide a impedance transformation. Such impedance transformation reduces reflections, and is accomplished, generally speaking, by selecting the dimension of the steps 19–22 to cause mutually-cancelling or out-of-phase reflections. The combination of pin 15, ridge extension 17, front face 23 of ridge 11, and those portions of wide wall 8 and end plate 13 in the region under and adjacent to ridge extension 17 may be considered to form a coupling wire by which coupling into the coax is accomplished. Those elements of FIG. 2 corresponding to elements of FIG. 1 are designated by the same reference numbers.

Figure 3:
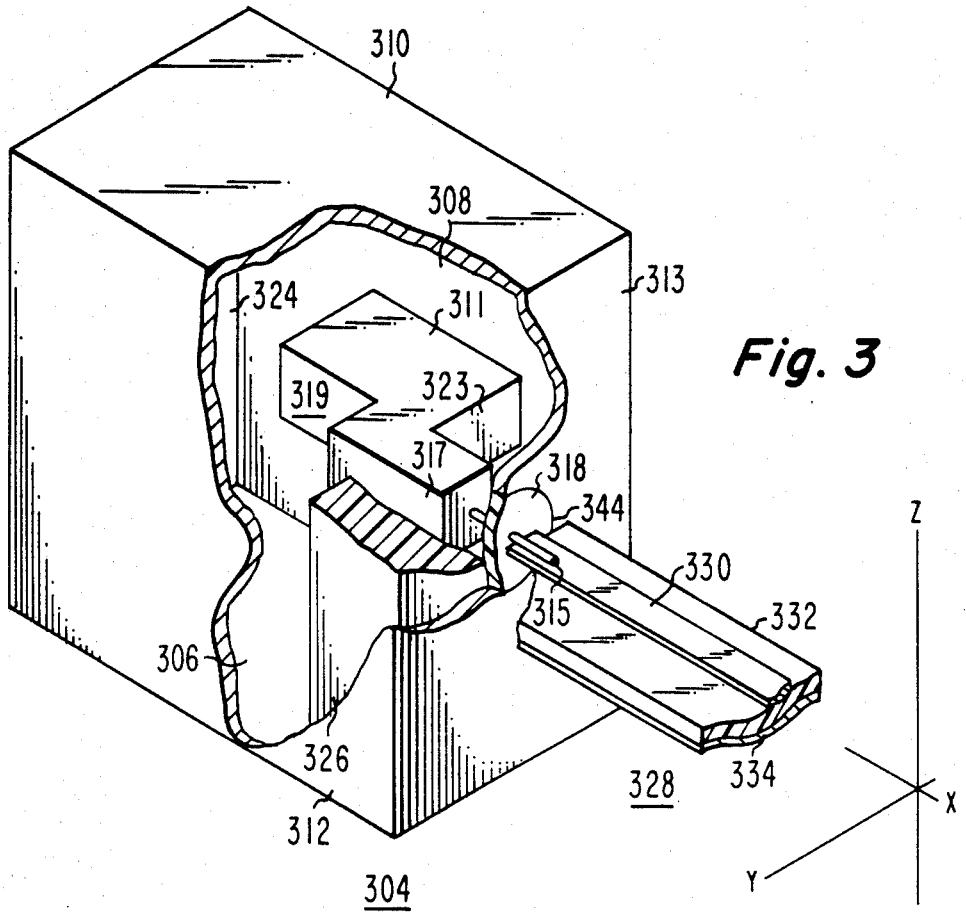
FIG. 3 is a view of a waveguide-to-microstrip transition according to the invention.

It has been discovered that by placing a dielectric material in the region adjacent the ridge extension, an increase in bandwidth by a factor of two or three may be achieved. FIG. 3 illustrates partially cut away, a waveguide-to-microstrip (or microstrip-to-waveguide) transition designated generally as 304. Those elements of 304 corresponding to elements found in FIG. 1 are designated with the same reference numerial but in the 300 series. In FIG. 3, transition 304 includes a waveguide section including spaced-apart broad walls 308 and 312 separated by narrow walls 306 and 310. The rectangular waveguide section thus formed includes an input port 324. A conductive end plate 313 defines a circular aperture 334 which is occupied by a dielectric sleeve or cylinder 318 and a center pin 315 (which is illustrated as being relatively small in order to reduce clutter in the drawing). A ridge 311 is coupled to broad wall 308 and includes an impedance matching step 319 and also includes a ridge extension cantilevered from or supported at one end by ridge 311. The end of ridge extension 317 is coupled to one end of pin 315. A microstrip transmission-line designated generally as 328 includes a thin, flat strip conductor 330 printed or otherwise attached to a flat dielectric plate 332. The bottom of plate 332 has formed on it a conductive layer or ground-plane 334. One end of strip conductor 330 is connected to pin 315, as for example by soldering or welding, and ground plane 334 is similarly connected (by means not illustrated) to conductive end plate 313 in the region immediately adjacent to aperture 344. A bandwidth extending dielectric block 326 illustrated partially-cut-away extends from wall 306 to wall 310 and has a thickness equal to the distance between ridge extension 317 and broad wall 312.

The arrangement of transition 304 is capable of a much broader impedance bandwidth than the arrangement illustrated in FIG. 1. By comparison with prior art ridge-waveguide-microstrip transitions, it also has the salient advantage of allowing any desired orientation of the plane of microstrip plate 328. As illustrated in FIG. 3, microstrip plate 328 is oriented parallel to the narrow walls 306 and 310.

Figure 4C:
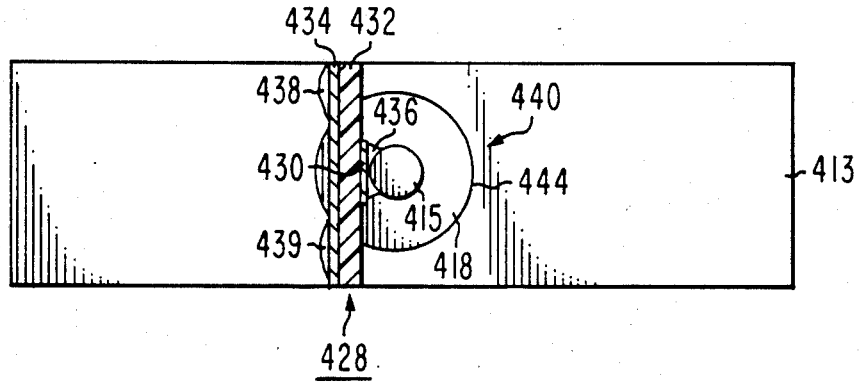
FIGS. 4*a*, 4*b*, and 4*c* are cross-sectional views of a waveguide-to-microstrip transition according to the invention.
Figure 4A:
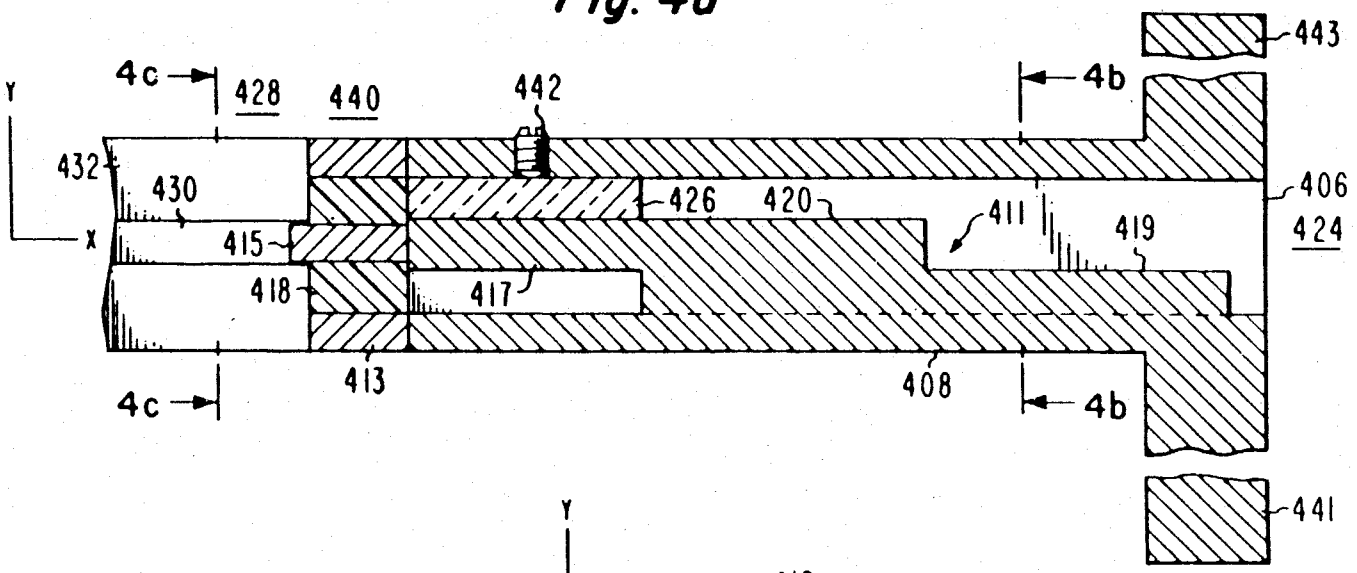

FIG. 4*a* is a sectional view of a preferred embodiment of a waveguide-to-microstrip transition. In FIG. 4, elements corresponding to those of FIGS. 1 and 3 are designated by the same reference numerials in the 400 series. In FIG. 4*a*, broad walls 408 and 412 are seen in cross-sectional view. Waveguide port 424 is on the right, and a ridge 411 including a first step 419 and a second step 420 is intergral with wall 408. A flange 441 is formed integrally with wall 408 and a flange 443 is formed integrally with wall 412. At the left of the FIG. 4*a*, walls 408 and 412 end at a short coaxial section designated generally as 440, which includes a cylindrical center conductor 415 surrounded by a dielectric washer or cylinder 418. Thus, the dielectric constant surrounding center conductor 415 is the same in all radial directions along coax section 440. A ridge extension 417 extends in the direction of the x axis between ridge 411 and center conductor 415. In the region between ridge extension 417 and upper wall 412, a dielectric plate 426 is held in place by a screw 442 threaded into a threaded aperture formed in wall 412 which bears against dielectric plate 426 and captivates the dielectric plate between the screw and ridge extension 417. A portion of a microstrip transmission-line designated generally designated as 428 includes a dielectric plate 432 lying in the x-y plane with its strip conductor 430 adjacent to pin 415 and soldered thereto.

Figure 4B:
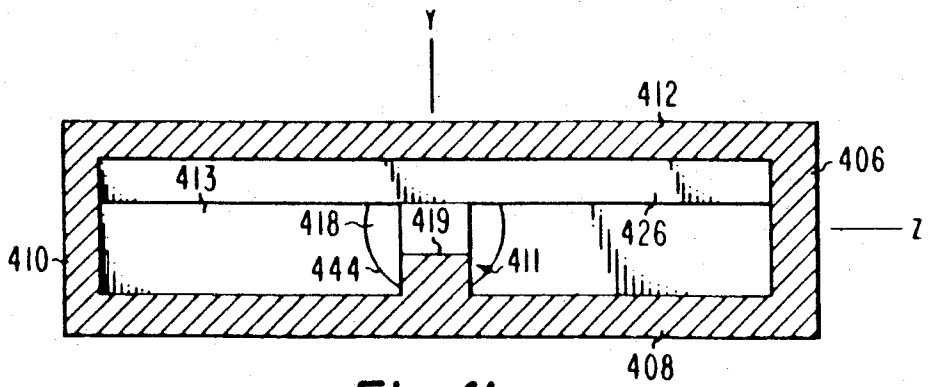

In the cross-sectional view of FIG. 4*b*, the width of ridge 411 can be seen in relation to the width of the waveguide. Also visible in FIG. 4*b* is conductive rear wall 413 which closes off the end of the waveguide opposite input port 424. The outline 444 of a circular aperture formed in rear wall 413 can be seen, together with dielectric cylinder or washer 418, which is part of coaxial section 440. Dielectric plate 426 can be seen to extend completely across the width of the waveguide.

Referring now to FIG. 4*c*, which is a cross-sectional view along section lines C—C of FIG. 4*a*, the orientation of microstrip line 428 relative to the waveguide portion of the transition can be seen. The outline 444 of the circular aperture in rear wall 413, dielectric cylinder 418 and center-conductor 415 of coaxial section 440 in their relation to microstrip line 428 are visible. Narrow microstrip conductor 430 is immediately adjacent to center conducter 415 and is soldered thereto by solder 436. Microstrip ground plane 434 on the side of dielectric plate 432 opposite strip conductor 436 is soldered to rear wall 413 by solder connections 438 and 439 disposed on either side of the aperture defined by outline 444.

The described transition is particularly advantageous in that leakage radiation near the transition is minimized so that the transition losses are low, and also because the microstrip plate may be oriented in positions other than those in which the dielectric plate is parallel to a broad wall of the waveguide. An orientation such as that illustrated in FIGS. 4*a* and 4*c* is particularly advantageous where a high packing density is desired, as for spacecraft application.

In the particular embodiment of the invention illustrated in FIGS. 3 and 4, for use with half-height WR-75 waveguide having internal cross-sectional dimensions of 0.144 inches by 0.750 inches (3.65×19.05 mm) and having a nominal impedance of 151 ohms, the following dimensions where found to provide satisfactory operation.

| | inches | mm |
|---|---|---|
| Width of ridge (dimension in z direction) | 0.070 | 1.78 |
| Height of step 419 (dimension in y direction) | 0.044 | 1.12 |
| Length (dimension in x direction) of step 419 | 0.318 | 8.08 |
| Height of step 420 | 0.098 | 2.49 |
| Length of step 420 | 0.295 | 7.49 |
| Width of ridge extension 417 | 0.070 | 1.78 |
| Thickness (dimension in y direction) of ridge extension 417) | 0.052 | 1.32 |
| Length (dimension in x direction of ridge extension 417) | 0.246 | 6.25 |
| Diameter of dielectric cylinder 418 | 0.144 | 3.65 |
| Diameter of center conduct or 415 | 0.040 | 1.01 |
| Impedance of strip line, ohms | 50 | |
| Dielectric constant of plate 426 glass or fused quartz $\epsilon \approx 3.8$ | | |
| Dielectric constant of cylinder 418 tetrafluoroethylene (Teflon) $\epsilon \approx 2.0$ | | |

Figure 5:
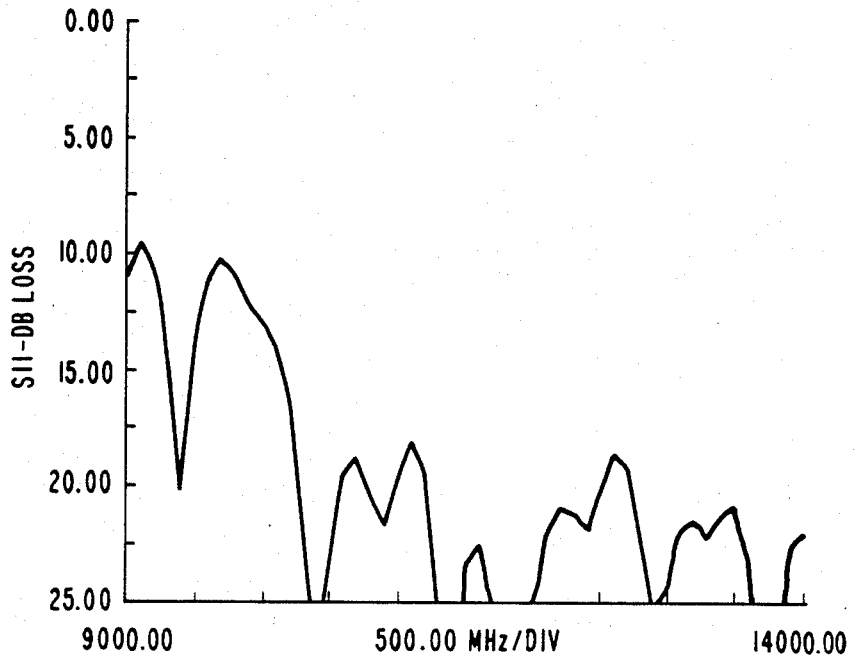
FIG. 5 is a plot of input impedance return loss vs frequency of the transition of FIG. 4.
Figure 6:
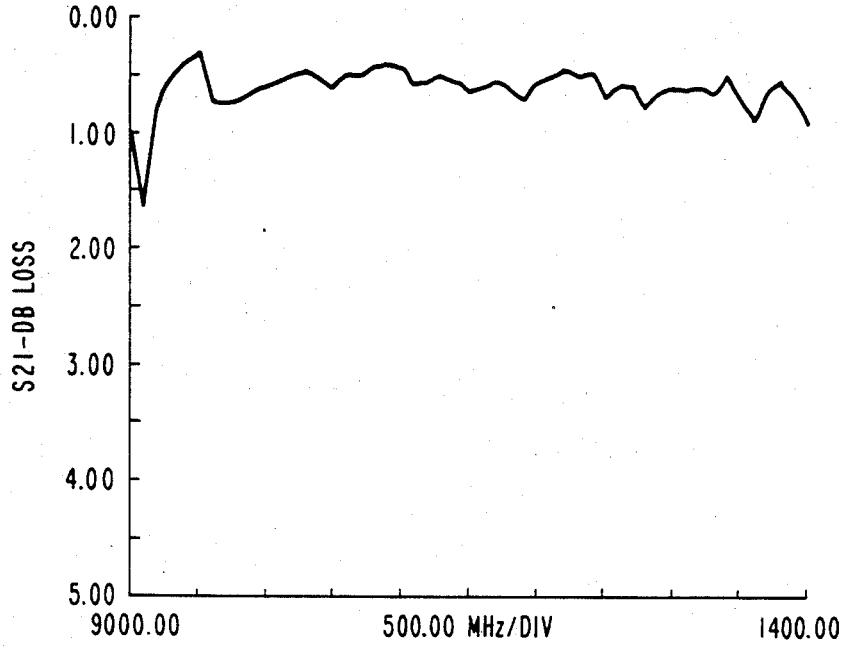
FIG. 6 is a plot of attenuation vs frequency of two of the transitions of FIG. 4 connected back-to-back.

FIG. 5 illustrates the measured input return loss of two waveguide-to-microstrip transitions having parameters as tabulated as above and connected back-to-back by a microstrip line having a length of 0.25 inches. The input return loss ($s_{11}$) is better than 18 db from 10.3 GHz to 14.3 GHz, which is a bandwidth of 4 GHz. The insertion loss of the back-to-back transitions is illustrated in FIG. 6. Taking into account the 0.1 dB loss of the interconnecting microstrip line, the actual loss for one transition such as that described in FIG. 4 is only 0.25 dB from 10.3 to 14.3 GHz.

Other embodiments of the invention will be apparent to those skilled in the art. For example, the number of impedance-matching steps of the waveguide ridge may be selected for the degree of impedance match required. A tapered-height ridge may be used for impedance transformation rather than a stepped ridge. The ridge may be manufactured as an integral part of the broad wall which supports it, or it may be assembled to the broad wall. The ridge extension may be assembled to the ridge, if desired.

What is claimed is:

1. A transition, comprising:

a section of rectangular waveguide defining a first axis, said section of rectangular waveguide including first and second mutually-parallel conductive wide walls equally spaced from a first plane in which said first axis lies by a pair of mutually parallel conductive narrow walls, said pair of narrow walls being equidistant from a second plane in which said axis lies, said second plane being orthogonal to said first plane, said section of rectangular waveguide defining a first rectangular waveguide port centered on said axis and a second port also centered on said axis at a point remote from said first rectangular waveguide port;

a conductive plate defining a circular aperture, said conductive plate being coupled to said rectangular waveguide section at said second port and being oriented orthogonal to said axis with said aperture located equidistant from said pair of narrow walls for reducing the size of said second port to the size of said circular aperture;

a coaxial transmission line including an outer conductor and a center conductor having a common second axis therewith, one end of said coaxial transmission line being coupled to said circular aperture in such a fashion that said second axis passes through the center of said circular aperture, one end of said center conductor passing through said circular aperture;

a flat waveguide ridge having sides parallel to and centered on said second plane, and having a first straight edge coupled to said first wide wall, and a second edge at a varying height from said first edge, said height being least in that portion of said ridge nearest said first rectangular waveguide port, said height being greatest in that portion of said ridge nearest said circular aperture;

a waveguide ridge extension extending between said second edge of that portion of said ridge nearest said circular aperture and said center conductor, said waveguide ridge extension being remote from both said first and second wide walls, thereby defining a rectangular-waveguide-to coax transition having a predetermined bandwidth; and a dielectric plate parallel with said second wide wall and located between said second wide wall and said waveguide ridge extension for increasing said bandwidth.

2. A transition according to claim 1 wherein said varying height of said planar waveguide ridge varies in steps in the direction of said first axis.

3. A transition according to claim 2 wherein the length of said step is approximately one-fourth wavelength at the design center frequency of operation of said transition.

4. A transition according to claim 1 wherein said dielectric plate extends along said second wide wall and comes into contact with said pair of narrow walls.

5. A transition according to claim 4 wherein said dielectric plate is a glass plate.

6. A transition according to claim 1 wherein said dielectric plate has a thickness equal to the distance between said waveguide ridge extension and said second wide wall.

7. A transition according to claim 6 wherein said second wide wall defines a threaded aperture centered on said second plane overlying said dielectric plate, and said dielectric plate is retained by a screw threaded into said threaded aperture.

8. A transition according to claim 6 wherein said dielectric plate is a glass plate.

9. A transition according to claim 8 wherein said glass plate extends from one narrow wall of said pair of narrow walls to the other narrow wall of said pair of narrow walls.

10. A transition according to claim 1 further comprising a microstrip transmission line including a strip conductor coupled at one end to said center conductor of said coaxial transmission line, and also including a ground plane coupled to said conductive plate at a point adjacent said circular aperture, said ground plane being parallel to said second plane.

11. An improved waveguide-to-TEM-mode transmission-line transition, comprising:

first and second mutually parallel conductive wide walls equidistant from a first plane;

first and second mutually parallel conductive narrow walls equidistant from a second plane orthogonal to said first plane, said first and second narrow walls being coupled along their edges to said first and second wide walls, thereby defining a rectangular waveguide having an axis coextensive with the juncture of said first and second planes;

a conductive plate defining an aperture, said conductive plate being orthogonal to both said first and second planes and coupled to said first and second wide and narrow walls for closing off said rectangular waveguide but for said aperture, said plate being located so that the center of said aperture lies in said second plane;

coaxial transmission-line means including an outer conductor terminating at said aperture and also including a center conductor passing through said aperture, said coaxial transmission-line means having the same dielectric constant in all radial directions from said center conductor;

a stepped ridge centered on said second plane and coupled to said first wide wall, said stepped ridge including a plurality of steps at distances from said second wide wall which decrease with increasing proximity of said steps to said conductive plate;

a ridge extension cantilevered from said stepped ridge to a region near said aperture and electrically coupled to said center conductor, thereby defining a transition having a predetermined bandwidth; wherein the improvement comprises a dielectric plate coupled in the region between said ridge extension and said second wide wall for increasing said bandwidth.

12. A transition according to claim 11 wherein said plurality of steps is two.

13. A transition according to claim 11 wherein said dielectric plate extends from said first narrow wall to said second narrow wall.

14. A transition according to claim 11 wherein said dielectric plate comprises glass.

15. A transition according to claim 11 wherein said aperture is a circular aperture.

16. A transition according to claim 11 further comprising a microstrip transmission-line including a strip conductor coupled at one end to said center conductor and also including a ground-plane connected to said conductive plate at a point adjacent said circular aperture.

17. A transition according to claim 16 wherein said ground-plane is oriented parallel to said second plane.

* * * * *